US009527121B2

(12) United States Patent
Denker

(10) Patent No.: US 9,527,121 B2
(45) Date of Patent: Dec. 27, 2016

(54) METHOD FOR ADJUSTING THE ROLLS OF A ROLL STAND AND ROLL STAND

(75) Inventor: Wolfgang Denker, Freudenberg (DE)

(73) Assignee: SMS GROUP GMBH, Düsseldorf (DE)

( * ) Notice: Subject to any disclaimer, the term of this patent is extended or adjusted under 35 U.S.C. 154(b) by 1249 days.

(21) Appl. No.: 13/393,165

(22) PCT Filed: Aug. 25, 2010

(86) PCT No.: PCT/EP2010/005207

§ 371 (c)(1),
(2), (4) Date: Feb. 28, 2012

(87) PCT Pub. No.: WO2011/023378

PCT Pub. Date: Mar. 3, 2011

(65) Prior Publication Data

US 2012/0151980 A1 Jun. 21, 2012

(30) Foreign Application Priority Data

Aug. 31, 2009 (DE) ..... 10 2009 039 501

(51) Int. Cl.
*B21B 38/10* (2006.01)
*B21B 31/24* (2006.01)
(Continued)

(52) U.S. Cl.
CPC ..... *B21B 38/10* (2013.01); *B21B 31/24* (2013.01); *B21B 37/60* (2013.01); *B21B 13/147* (2013.01);
(Continued)

(58) Field of Classification Search
CPC ..... B21B 37/58; B21B 37/60; B21B 37/62; B21B 31/16; B21B 31/22; B21B 31/20; B21B 31/24; B21B 38/105; B21B 38/10; B21B 2271/02
See application file for complete search history.

(56) References Cited

U.S. PATENT DOCUMENTS 3,358,485 A * 12/1967 De Caro ..... B21B 38/10 72/10.7
3,626,740 A * 12/1971 Hinterholzl ..... B21B 31/20 72/244
(Continued)

FOREIGN PATENT DOCUMENTS

CN 1747801 3/2006
EP 0309394 A 3/1989
(Continued)

*Primary Examiner* — Moshe Wilensky
*Assistant Examiner* — Pradeep C Battula
(74) *Attorney, Agent, or Firm* — Lucas & Mercanti, LLP; Klaus P. Stoffel

(57) ABSTRACT

The invention relates to a method for adjusting the rolls (1, 2, 3, 4) of a roll stand (5), wherein the roll stand (5) comprises at least two interacting working rolls (1, 2), wherein one of the working rolls (1) is arranged in the roll stand (5) in a displaceable manner for adjusting a roll gap, and wherein the other working roll (2) can be rotated in the roll stand (5) in a working position, but for defining a passline (p) in the direction normal to the surface of the roll material is fixed in a non-displaceable manner. In order to increase the rolling accuracy, the invention proposes the following steps: a) determining the position ($S_{ist}$) of the working roll (2) arranged in a fixed manner in the roll stand (5); b) comparing the determined value ($S_{ist}$) of the position to a target value ($S_{soll}$); c) adjusting the working roll (2) fixedly arranged in the roll stand (5) depending on the comparison value determined in step b) using at least one adjusting element (6) such that the position (S) of the working roll (2) fixedly arranged in the roll stand (5) at least largely reaches the target value ($S_{soll}$). The invention further
(Continued)

relates to a roll stand comprising at least two interacting working rolls.

10 Claims, 2 Drawing Sheets

(51) Int. Cl.
*B21B 37/60* (2006.01)
*B21B 13/14* (2006.01)
*B21B 37/58* (2006.01)
*B21B 13/02* (2006.01)

(52) U.S. Cl.
CPC ..... *B21B 37/58* (2013.01); *B21B 38/105* (2013.01); *B21B 2013/028* (2013.01); *B21B 2267/24* (2013.01); *B21B 2271/02* (2013.01); *Y10T 29/49718* (2015.01)

(56) References Cited

U.S. PATENT DOCUMENTS 3,744,287 A * 7/1973 Silva et al. ..... 72/8.6
4,149,395 A * 4/1979 Fapiano ..... B21B 37/68 72/11.7
4,991,420 A 2/1991 Frischknecht et al.
5,029,400 A * 7/1991 Leclercq ..... B21B 38/10 72/13.4
5,479,809 A 1/1996 Stachuletz et al.
5,520,037 A * 5/1996 Sorgel ..... B21B 37/58 72/10.3
5,560,237 A * 10/1996 Yasuda ..... B21B 13/145 72/243.2
6,401,506 B1 * 6/2002 Ogawa ..... B21B 37/68 72/10.4
8,459,074 B2 * 6/2013 Hofer ..... B21B 37/68 72/10.4
8,539,804 B2 * 9/2013 Jonsson ..... B21B 37/28 72/11.7
2001/0020378 A1 * 9/2001 Hartmann ..... B21B 38/105 72/225
2008/0016932 A1 1/2008 Denker

FOREIGN PATENT DOCUMENTS

EP 0513946 11/1992
EP 1601475 B1 5/2007
FR 2521040 A1 * 8/1983 ..... B21B 37/165
JP 6152922 3/1986
JP 8229605 9/1996
SU 884769 11/1981
SU 937068 6/1982
SU 1704871 1/1992

* cited by examiner

METHOD FOR ADJUSTING THE ROLLS OF A ROLL STAND AND ROLL STAND

The present application is a 371 of International application PCT/EP2010/005207, filed Aug. 25, 2010, which claims priority of DE 10 2009 039 501.6, filed Aug. 31, 2009, the priority of these applications is hereby claimed and these applications are incorporated herein by reference.

BACKGROUND OF THE INVENTION

The invention pertains to a method for adjusting the rolls of a roll stand, wherein the roll stand comprises at least two cooperating work rolls, wherein one of the work rolls is mounted movably in the roll stand for adjusting the roll gap, and wherein the other work roll in the roll stand is mounted rotatably in a working position but is held fixedly in the direction perpendicular to the surface of the in-process stock for defining a pass line. The invention also pertains to a roll stand with at least two cooperating work rolls. The inventive roll stand can be in particular a 6-high, a 20-roll, or a Z-high roll stand.

It is generally known that the work rolls mounted in a stand to roll the selected in-process stock—and the back-up rolls, which are usually also provided—can be arranged so that the "lower" rolls in the roll stand are fixed in place in a defined position in their chocks, so that a pass line is defined for the in-process stock. The "upper" rolls, however, are mounted so that they can be adjusted in the vertical direction to set the size of the roll gap between the two work rolls. Whereas appropriate adjusting means, which can be used to position the rolls in the desired or required vertical position, are therefore known for the "upper" rolls, this is not true for the "lower" rolls, because these should and must be unable to move vertically.

With respect to the position of the rolls in the roll stand, a great deal of effort is always expended to keep them as parallel to each other as possible, which is necessary not only to guarantee the production of rolled stock of sufficient quality but also to ensure the optimal operation of the devices downstream from the roll stand (e.g., deflecting rolls or coiling units). If the rolls are not parallel, the way in which the tension in the strip is distributed during the rolling process becomes distorted, and damaging axial forces develop in the roller bearings, which can lead to a loss of quality and increased wear.

When a roll stand is being designed, appropriate efforts are therefore made to ensure the parallelism of the rolls. The problem here is that, because of the size of the necessary components (which can be up to 20 m high and weigh up to 300 tons), the limits for the achievable accuracies and tolerances are quickly reached from an economic standpoint. During the installation of the slide plates, thrust pieces, chocks, and other necessary components, the tolerances add up to a largest possible and a smallest possible value.

In the normal case, therefore, the upper back-up roll is moved vertically together with the work roll to regulate the thickness (setting of the roll gap). During this process, the lower back-up roll and work roll remain in the position previously set before the start of rolling. The lower work roll is therefore held fixedly in place, and so that it can be positioned accurately, shims or movable auxiliary adjusting devices (adjusting wedges or spindles) are placed underneath. Because of the additive nature of the tolerances, however, the rolls can be out of parallel by up to 0.5 mm/m. Such lack of parallelism affects the rolling process, because other automatic controls such as the flatness control circuit depend on the measurements of the tension distribution over the cross section of the strip.

The present invention is therefore based on the goal of proposing a method which makes it possible to ensure that the rolls are precisely parallel, wherein both manufacturing tolerances and the lack of parallelism caused by different degrees of wear, which is another factor affecting the horizontal position of the rolls, can be compensated, as a result of which the rolling process can be more easily controlled.

The way in which the invention achieves this goal is characterized in that the method comprises the following steps:

SUMMARY OF THE INVENTION (a) determining the position of the work roll mounted fixedly in the roll stand;

(b) comparing the determined position value with a nominal value; and (c) moving the work roll mounted fixedly in the roll stand by means of at least one adjusting element as a function of the comparison value determined in step (b), so that the position of the work roll mounted fixedly in the roll stand matches or comes at least very close to matching the nominal value.

The method is conducted preferably before the in-process stock is rolled. It is also recommended after a change of rolls.

Determining the position according to step (a) above is preferably carried out either on the barrel of the roll or at a reference point on the roll chock of the work roll mounted fixedly in the roll stand.

Determining the position according to step (a) above is carried out preferably at both axial ends of the work roll mounted fixedly in the roll stand.

Each of the work rolls is preferably supported by at least one back-up roll, wherein the adjustment according to step (c) above is carried out on the back-up roll of the work roll mounted fixedly in the roll stand. The adjustment is carried out preferably on the chock of the back-up roll.

The adjustment according to step (c) above, furthermore, is preferably carried out by the use of a tension/compression spindle with a combination of a right-hand and a left-hand thread. The use of shims or flat washers is also possible.

The roll stand with at least two cooperating work rolls, wherein one of the work rolls in the roll stand is mounted movably for adjusting the roll gap, and wherein the other roll in the roll stand is mounted rotatably in a working position but is held fixedly in the direction perpendicular to the surface of the in-process stock for defining a pass line, is characterized in that measuring means are present to determine the position of the work roll mounted fixedly in the roll stand; in that comparison means are present for comparing the determined position value with a nominal value; and in that at least one adjusting element is present for adjusting the work roll mounted fixedly in the roll stand as a function of the difference, found by the comparison means, between the determined value and the nominal value.

The measuring means can be positioned to measure the position of the barrel of the work roll. The roll chock can comprise a reference point for the measurement by the measuring means.

The measuring means can be permanently installed in the roll stand, or they can be mounted replaceably and used temporarily for the measurements.

The adjusting element is preferably a tension/compression spindle with a combination of a right-hand and a left-hand thread.

The invention is based on the idea of determining the position of the roll mounted fixedly in the roll stand, of comparing this value with a nominal value, and of correcting the deviation between the actual value and the nominal value by the use of an adjusting element before the in-process stock is rolled. The method is preferably carried out after a change of rolls.

Ideally, the position of the roll is detected at the barrel; alternatively, it can be determined at measurement points on the chocks. Movable or stationary sensors can be used to detect the position of the roll.

The adjusting elements can, in the simplest form, consist of flat washers, but they can also consist of individually adjustable auxiliary adjusting elements or of pairs of rotatable right-hand and left-hand threads, which are machined into compression/tension spindles. Such spindles for rolling mills are known from EP 1 601 475 B1. The drive or operating side of the roll stand is shifted or shimmed in such a way that the "fixed" roll reaches the nominal value precisely.

Figure 1:
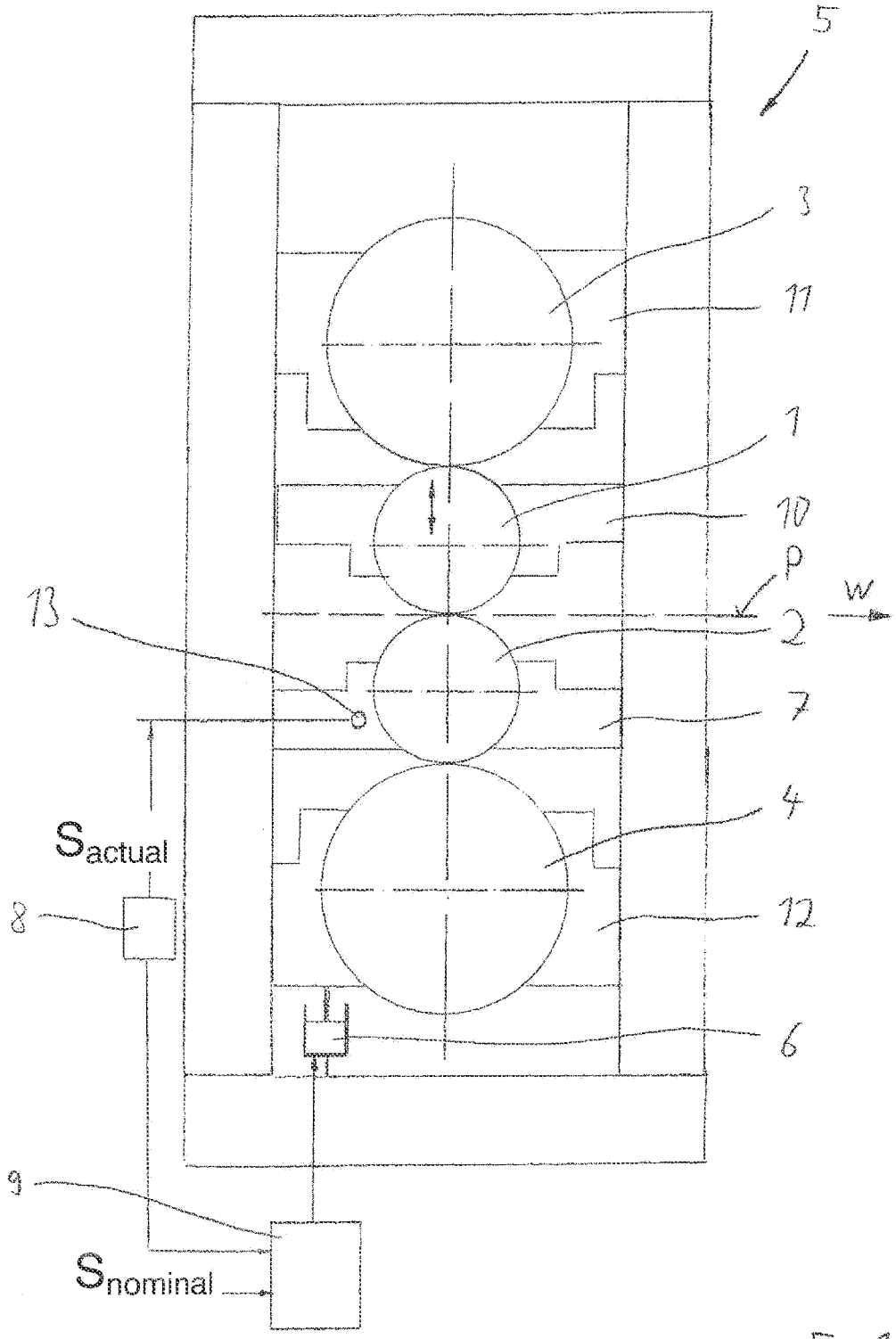
FIG. 1 shows a schematic side view of a roll stand with two work rolls and two back-up rolls.

The figures show a roll stand 5, in which four rolls in all are installed, namely, two cooperating work rolls 1 and 2 and two back-up rolls 3 and 4. Each roll 1, 2, 3, 4 is supported in a chock and fastened in the roll stand 5, namely, the lower work roll 2 in the chock 7, the lower back-up roll 4 in the chock 12, the upper work roll 1 in the chock 10 and the upper back-up roll 3 in the chock 11.

The two lower rolls 2 and 4 are mounted in a "fixed" manner; that is, they are held at a height in the roll stand 5 such that the topmost point of the work roll 2 forms a pass line P for the in-process stock (not shown). To adjust the roll gap between the work rolls 1, 2, the lower work roll 2 therefore remains at the height at which it is mounted; meanwhile, the upper work roll 1 is shifted vertically in the roll stand 5 along with the back-up roll 3.

DETAILED DESCRIPTION OF THE INVENTION

The following procedure is used to obtain the optimal adjustment of the rolls in the roll stand 5 before the stock is rolled:

First, the position $S_{actual}$ of the work roll 2 held fixedly in the roll stand 5 is determined. For this purpose, a measuring means 8 is arranged in the roll stand 5. More precisely, two measuring means 8 are used, one of which is provided at each axial end of the roll (see FIG. 2). For example, a reference point 13 located on the chock 7 (see FIG. 1) can be measured; such a reference point is preferred.

The measured actual values $S_{actual}$ (or $S_{actual1}$ and $S_{actual2}$) of the roll position are then compared with a stored nominal value $S_{nominal}$. A comparison means 9 is used for this purpose.

As a function of the difference found between the actual value and the nominal value, the work roll 2 is then shifted vertically in the roll stand 5. At least one, preferably two adjusting elements 6 are available for this purpose, which are used to adjust the height of the chock 7 of the work roll.

Figure 2:
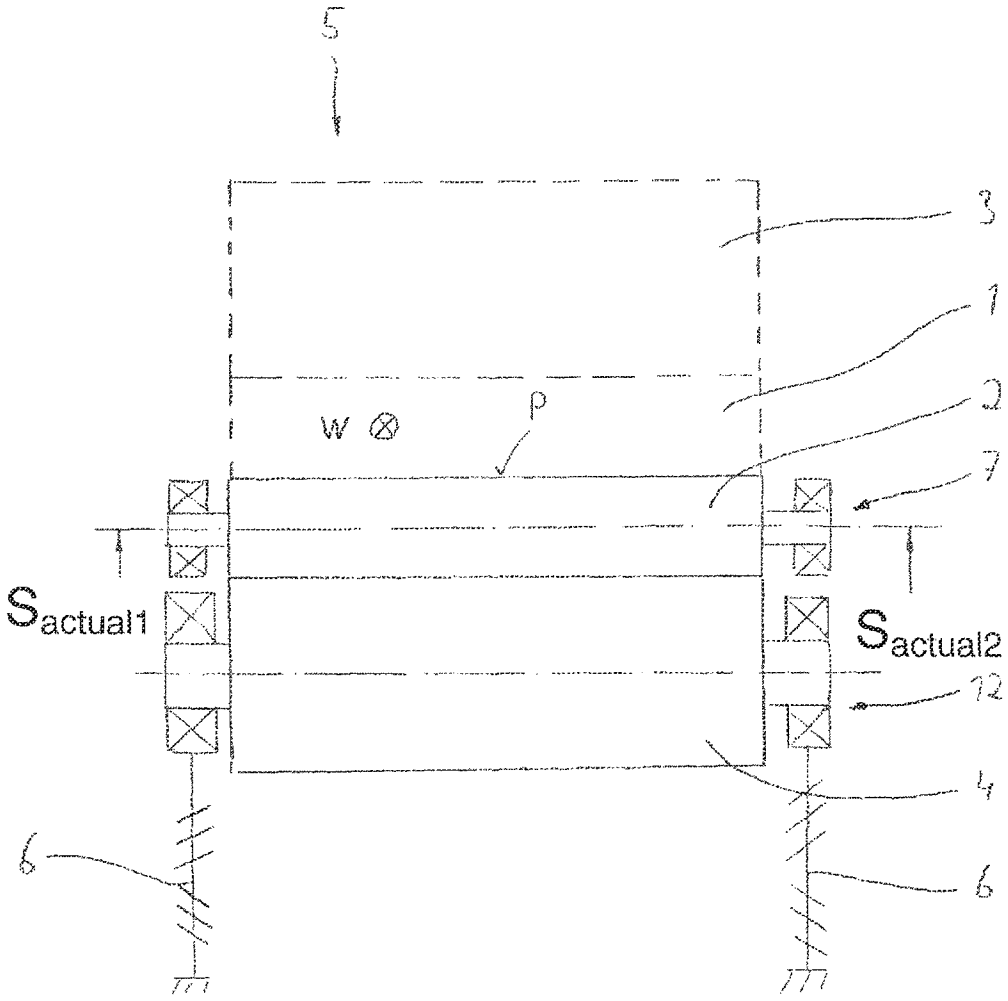
FIG. 2 shows part of the roll stand, seen in the rolling direction.

Indicated schematically in FIG. 2 are tension/compression spindles 6, which are provided with a combination of a right-hand and a left-hand thread, so that, when the spindle turns, the two axial ends of the spindle travel toward or away from each other. The adjusting distance is selected so that the position S of the work roll 2 held fixedly in the roll stand 5 assumes the nominal value $S_{nominal}$.

It is obvious that the difference between the actual position and the nominal position determined by the comparison means 9 is converted into an adjusting movement by suitable open-loop or closed-loop control means, which are not shown in the figures.

LIST OF REFERENCE SYMBOLS

1. roll (work roll)
2 roll (work roll)
3 roll (back-up roll)
4 roll (back-up roll)
5 roll stand
6 adjusting element
7 roll chock of work roll 2
8 measuring means
9 comparison means
10 roll chock of work roll 1
11 roll chock of back-up roll 3
12 roll chock of back-up roll 4
13 reference point
S position of the work roll
$S_{actual}$ actual position of the work roll
$S_{nominal}$ nominal position of the work roll
W rolling direction
P pass line

The invention claimed is:

1. A method for adjusting rolls of a roll stand, wherein the roll stand comprises at least two cooperating work rolls, wherein one of the work rolls in the roll stand is mounted movably for adjusting a roll gap, and wherein the other work roll in the roll stand is mounted rotatably in a working position but is held fixedly, during rolling, in a direction perpendicular to a surface of in-process stock for defining a pass line, wherein the method for adjusting a height of the lower work roll before rolling comprises the steps of:

(a) determining a position of a work roll before rolling using a measuring device at a reference point, wherein the work roll is mounted fixedly in the roll stand during rolling;

(b) comparing the determined position value with a nominal value before rolling; and (c) adjusting the height before rolling of the work roll mounted fixedly in the roll stand and supported in a chock in a vertical direction by at least one adjusting element acting on a lower back-up roll as a function of the comparison value determined in step (b), so that the position of the work roll mounted fixedly in the roll stand for forming a pass line for the in-process stock matches the nominal value; and (d) beginning rolling.

2. The method according to claim 1, including carrying out the method before the in-process stock is rolled, with or without the in-process stock in the stand.

3. The method according to claim 1, including carrying out the method after a change of rolls, with or without in-process stock in the stand.

4. The method according to claim 1, including carrying out the determining of the position in step (a) on a barrel of the roll.

5. The method according to claim 1, including carrying out the determining of the position in step (a) on a reference point of the roll chock of the work roll held fixedly in the roll stand.

6. The method according to claim 1, including carrying out the determining of the position in step (a) at both axial ends of the work roll held fixedly in the roll stand.

7. The method according to claim 1, wherein each of the work rolls is supported by at least one back-up roll, the method including carrying out the adjusting in step (c) on the back-up roll of the work roll held fixedly in the roll stand.

8. The method according to claim 7, including carrying out the adjusting on the roll chock of the back-up roll.

9. The method according to claim 1, including carrying out the adjusting in step (c) by using a tension/compression spindle with a combination of a right-hand and a left-hand thread.

10. The method according to claim 1, including carrying out the adjusting in step (c) by using shims or flat washers.

* * * * *